US008455803B2

(12) United States Patent
Danzer et al.

(10) Patent No.: US 8,455,803 B2
(45) Date of Patent: Jun. 4, 2013

(54) WAVE CHOKE DEVICE FOR A MICROWAVE OVEN DOOR

(75) Inventors: Norbert Danzer, Gebsattel (DE); Martin Gasch, Rothenburg (DE); Abdel-Ilah Zbat, Wurzburg (DE); Arnd Hofmann, Lulsfeld (DE)

(73) Assignee: Electrolux Home Products Corporation, Zaventem (BE)

( * ) Notice: Subject to any disclaimer, the term of this patent is extended or adjusted under 35 U.S.C. 154(b) by 390 days.

(21) Appl. No.: 12/675,431

(22) PCT Filed: Jul. 30, 2008

(86) PCT No.: PCT/EP2008/006276

§ 371 (c)(1),
(2), (4) Date: Jul. 8, 2010

(87) PCT Pub. No.: WO2009/030320

PCT Pub. Date: Mar. 12, 2009

(65) Prior Publication Data

US 2010/0301040 A1 Dec. 2, 2010

(30) Foreign Application Priority Data

Sep. 3, 2007 (EP) ..... 07017207

(51) Int. Cl.
*H05B 6/76* (2006.01)

(52) U.S. Cl.
USPC ..... 219/741; 219/736; 219/737; 219/738; 219/739

(58) Field of Classification Search
USPC ..... 219/736–739, 741
See application file for complete search history.

(56) References Cited

U.S. PATENT DOCUMENTS

| | | | | |
|---|---|---|---|---|
| 3,809,842 | A * | 5/1974 | Slusher | 200/221 |
| 4,053,731 | A * | 10/1977 | Foerstner | 219/742 |
| 4,254,318 | A * | 3/1981 | Ohkawa et al. | 219/741 |
| 4,390,767 | A * | 6/1983 | Bucksbaum et al. | 219/740 |
| 4,449,025 | A * | 5/1984 | Ikeda et al. | 219/741 |
| 4,523,069 | A * | 6/1985 | Staats | 219/742 |

(Continued)

FOREIGN PATENT DOCUMENTS

| | | |
|---|---|---|
| EP | 0122647 A1 | 10/1984 |
| EP | 0184069 A1 | 11/1986 |

(Continued)

OTHER PUBLICATIONS

International Search Report of PCT/EP2008/006276 dated Sep. 12, 2008.

*Primary Examiner* — A. Sefer
(74) *Attorney, Agent, or Firm* — Workman Nydegger

(57) ABSTRACT

The present invention relates to a wave choke device for an oven door of a microwave oven. The wave choke device includes a front shielding comprising at least one conductive material and a wave trap forming a channel with one at least partially open side, which wave trap is arranged on at least one outer portion of the front shielding and comprises at least one conductive material. The wave choke device includes further a plurality of lamellae arranged uniformly in the at least partially open side of the wave trap, which lamellae comprises at least one conductive material. The wave choke device comprises one single piece made of a perforated material, wherein said one single piece includes at least the front shielding and the wave trap. The present invention relates further to a corresponding oven door and a corresponding microwave oven.

17 Claims, 2 Drawing Sheets

U.S. PATENT DOCUMENTS

| | | | | |
|---|---|---|---|---|
| 4,645,892 | A * | 2/1987 | Gustafsson | 219/742 |
| 5,075,525 | A * | 12/1991 | Jung | 219/742 |
| 5,973,305 | A * | 10/1999 | Kim et al. | 219/742 |
| 7,126,097 | B2 * | 10/2006 | Kim et al. | 219/741 |
| 2003/0141298 | A1 * | 7/2003 | Lee et al. | 219/741 |
| 2008/0149629 | A1 * | 6/2008 | Beausse | 219/741 |

FOREIGN PATENT DOCUMENTS

| | | |
|---|---|---|
| EP | 0763964 A2 | 3/1997 |
| EP | 1511361 A2 | 2/2005 |
| GB | 2161349 A | 1/1986 |

* cited by examiner

WAVE CHOKE DEVICE FOR A MICROWAVE OVEN DOOR

BACKGROUND OF THE INVENTION

1. Field of the Invention

The present invention relates to a wave chokes device for an oven door of a microwave oven. Further, the present invention relates to an oven door for a microwave oven. Additionally, the present invention relates to a microwave oven.

2. Background and Relevant Art

A microwave oven generates strong electromagnetic fields in order to heat the food stuff. Said electromagnetic fields are potential threat to the health of the operator, if the electromagnetic fields or parts of them leave the cavity. The door of the microwave oven is critical. In particular, the microwaves may leave the cavity through the gap between the door and the cavity.

The gap between the door and the cavity is sealed with respect to microwaves by integrating a wave choke device into the door of the microwave oven. Said wave choke devices provide a small band stop by a cascaded "K/A-transformation. However, insufficient connections of security-relevant parts of the wave choke devices may cause a high risk of a leakage.

BRIEF SUMMARY OF THE INVENTION

It is an object of the present invention to provide a wave choke device for an oven door of a microwave oven, which reduces the risk of a leakage caused by insufficient connections of security-relevant parts.

This object is achieved by the wave choke device according to claim 1.

According to the present invention the wave choke device comprises one single piece made of a perforated material, wherein said one single piece includes at least the front shielding and the wave trap.

The main idea of the invention is that the front shielding and the wave trap are formed as on single part. This avoids insufficient electric connections between the wave trap and the front shielding and minimizes the risk that the microwave radiation leak from the oven cavity. The perforated material allows that the front shielding is optically transparent. The inventive wave choke device can be easily manufactured.

According to the preferred embodiment of the present invention the front shielding and the wave trap form the one single piece and the lamellae are fixed to the front shielding and/or to the wave trap by a galvanic connection.

According to an alternative embodiment of the present invention the one single piece includes the front shielding, the wave trap and at least a part of the plurality of lamellae.

Preferably, the lamellae extend in a radial direction within the plane of the oven door.

The one single piece may comprise a grid made of metal wires. The holes between the metal wires are smaller than the wavelength of the microwaves.

Further the one single piece may be made of metal in a raw condition. Alternatively, the one single piece is made of metal with a treated surface.

According to a further embodiment of the present invention the one single piece is made of a synthetic material treated with a conductive material. In particular, the synthetic material is thermoplastics.

Preferably, the wave trap forms a four-sided frame arranged on the outer portion of the front shielding. This guarantees a high shielding of the microwaves.

The present invention relates further to an oven door comprising the wave choke device described above.

The oven door comprises at least one door panel. Preferably, the door panel is made of a dielectric and/or transparent material. For example, the door panel is made of glass, glass ceramics and/or plastics.

According to the preferred embodiment of the present invention the wave choke device is arranged on the outer side of an inner door panel.

Additionally the present invention relates to a microwave oven comprising a wave choke device and/or an oven door as described above.

The novel and inventive features believed to be the characteristic of the present invention are set forth in the appended claims.

BRIEF DESCRIPTION OF THE DRAWINGS

The invention will be described in further detail with reference to the drawing, in which.

DETAILED DESCRIPTION OF THE PREFERRED EMBODIMENTS

Figure 1:
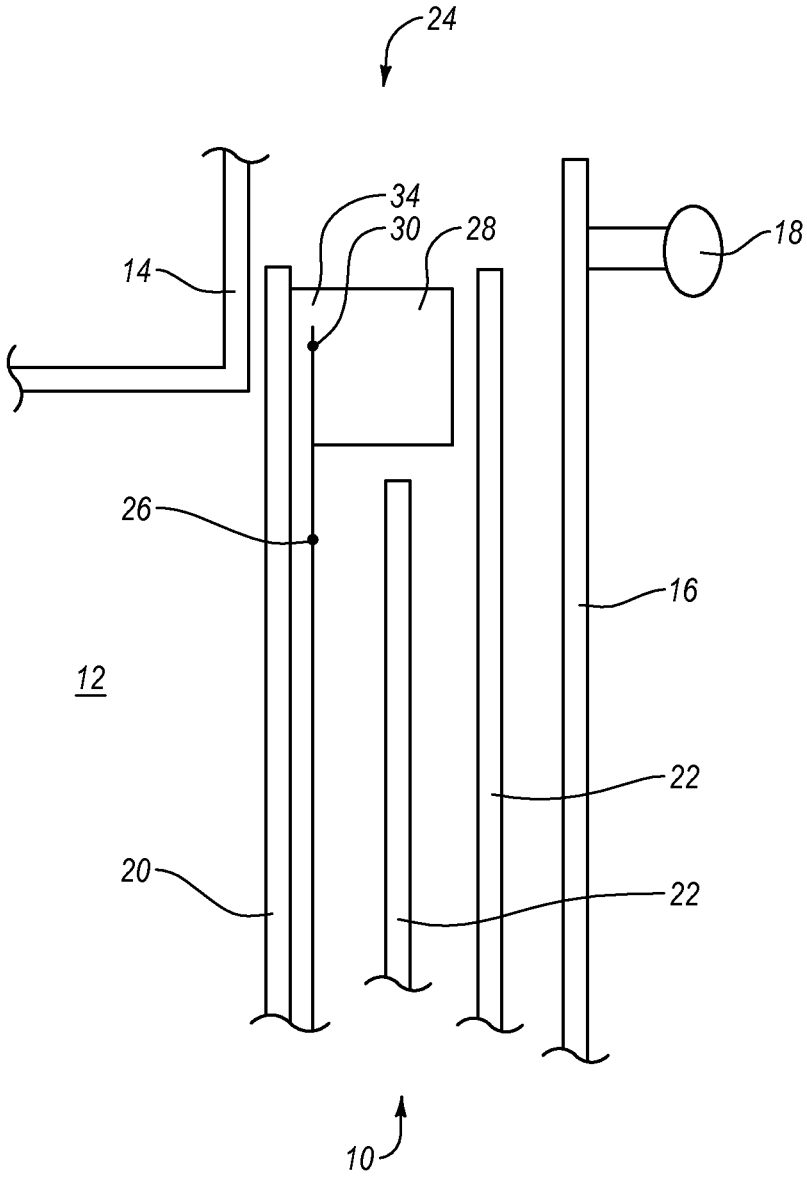
FIG. 1 illustrates a schematic sectional side view of an upper part of an oven door according to a preferred embodiment of the present invention.

FIG. 1 illustrates a schematic sectional side view of an upper part of an oven door 10 according to a preferred embodiment of the present invention. The oven door 10 is arranged in front of an oven cavity 12. The oven cavity 12 is enclosed by a cavity frame 14. The oven cavity 12 and the cavity frame 14 belong to a microwave oven.

The oven door 10 includes an outer door panel 16 on its outer side and an inner door panel 20 on its inner side. A handle 18 for opening the oven door 10 is arranged on the upper part of the outer door panel 16. Alternatively, a recessed grip may be arranged instead of the handle 18. Further, an electronic system for opening and closing the oven door can also be used. Between the outer door panel 16 and the inner door panel 20 further door panels 22 are arranged. In this example two further door panels 22 are arranged between the outer door panel 16 and the inner door panel 20. The outer door panel 16, the inner door panel 20 and the further door panels 22 are made of glass, glass ceramics or plastics. In general, the outer door panel 16, the inner door panel 20 and the further door panels 22 are made of transparent dielectric materials.

On the outer side of the inner door panel 20 a wave choke device 24 is arranged. Alternatively the wave choke device 24 may be fixed on the inner side of the outer door panel 16 or on one of the further door panels 22. The wave choke device 24 comprises a front shielding 26, a wave trap 28 and a plurality of lamellae 30. The front shielding 26 covers the open front side of the oven cavity 12. The wave trap 28 is formed as an open channel with a rectangular cross section. The wave trap 28 is arranged on at least one side of the inner door panel 20. Preferably, the wave trap 28 is arranged on all four sides of the inner door panel 20, so that the wave trap 28 forms a rectangular frame.

The wave trap 28 includes a U-shaped profile. The inner side of the wave trap 28 comprises a slot 34 extending parallel to the direction of the channel. The plurality of lamellae 30 are also arranged on the inner side of the wave trap 28. The lamellae 30 extend in radial direction in relation to the plane of the oven door 10. Further, the lamellae 30 extend perpendicular to the slot 34 in the inner side of the wave trap 28. In the closed state of the oven door 10 the lamellae 30 and the slot 34 are arranged beneath the gap between the oven door 10 and the cavity frame 14.

According to the preferred embodiment of the present invention the front shielding 26 and the wave trap 28 are formed as one single piece made of a perforated material. Said material may be all kinds of metal in a raw condition or with a treated surface. Further, the material may be a synthetic material, e.g. thermoplastic, with a conductive surface. Preferably, the material is expanded metal. The front shielding 26 and the wave trap 28 may consist of a grid made of metal wires.

According to a further embodiment of the present invention the front shielding 26 and the wave trap 28 as well as the lamellae 30 are formed as one single piece.

Figure 2:
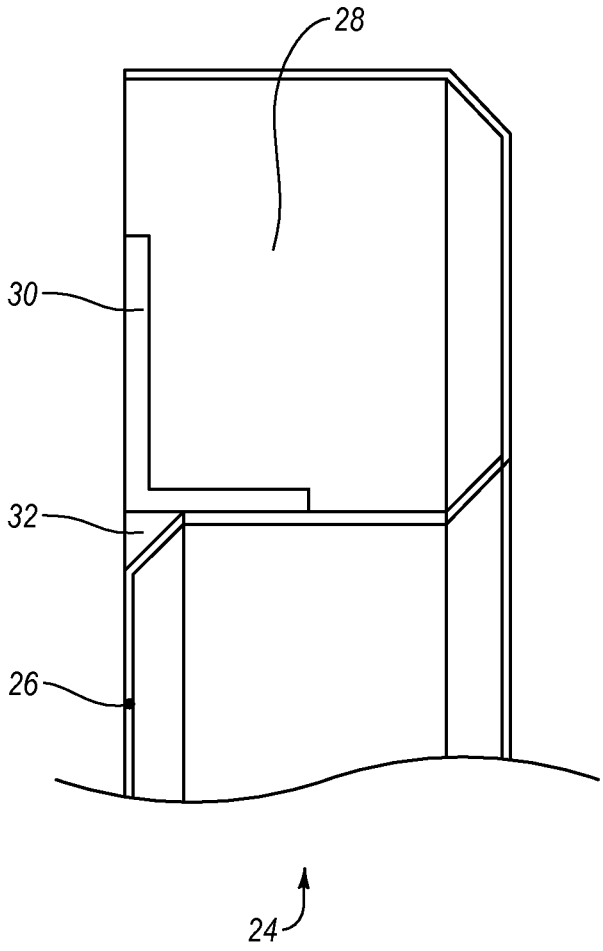
FIG. 2 illustrates a schematic sectional side view of an upper part of a wave choke device for the oven door according to the preferred embodiment of the present invention.

FIG. 2 illustrates a schematic sectional side view of an upper part of the wave choke device 24 for the oven door 10 according to the preferred embodiment of the present invention. The wave choke device 24 comprises the front shielding 26, the wave trap 28 and the plurality of lamellae 30. The wave trap 28 forms a channel with a substantially rectangular cross section. In this example the wave trap 28 forms a four-sided frame. In the closed state of the oven door 10 said four-sided frame is arranged opposite to the cavity frame 14.

The front shielding 26 and the wave trap 28 are formed as one single piece. Said one single piece is made of the perforated material. The front shielding 26 is optically transparent, but holds back the microwave radiation.

In this example the lamellae 30 are fixed to the wave trap 28 and to the front shielding 26 by a galvanic connection 32. Alternatively, the front shielding 26 and the wave trap 28 as well as the lamellae 30 are formed as one single piece. At last, the lamellae 30 can have a length of zero.

The wave choke device according to the present invention allows a reduced risk of a leakage by an insufficient connection. The inventive wave choke device can be manufactured in a simple way.

Although illustrative embodiments of the present invention have been described herein with reference to the accompanying drawing, it is to be understood that the present invention is not limited to those precise embodiments and that various other changes and modifications may be affected therein by one skilled in the art without departing from the scope or spirit of the invention. All such changes and modifications are intended to be included within the scope of the invention as defined by the appended claims.

LIST OF REFERENCE NUMERALS

10 oven door
12 oven cavity
14 cavity frame
16 outer door panel
18 handle
20 inner door panel
22 further door panel
24 wave choke device
26 front shielding
28 wave trap
30 lamella
32 galvanic connection
34 slot

We claim:

1. A wave choke device for an oven door of a microwave oven, comprising:

a front shielding comprising at least one conductive material, wherein the front shielding extends across an opening in the microwave oven;

a wave trap forming a channel with one at least partially open side, which wave trap is arranged on at least one outer portion of the front shielding and comprises at least one conductive material; and a plurality of lamellae arranged, in particular uniformly, in the at least partially open side of the wave trap, which lamellae comprise at least one conductive material, wherein:

the wave choke device comprises one single piece made of a material that is generally uniformly perforated throughout, wherein the generally uniform perforations in the material are smaller than the wavelengths of the microwaves produced by the microwave oven such that the microwaves cannot pass the wave choke; and said one single piece includes at least the front shielding and the wave trap, wherein the generally uniform perforations in the one single piece make the front shielding optically transparent to enable visual inspection through the oven door while stilling holding back microwaves.

2. The wave choke device according to claim 1, wherein the front shielding and the wave trap form the one single piece and the lamellae are fixed to the front shielding and/or to the wave trap by a galvanic connection.

3. The wave choke device according to claim 1, wherein the one single piece includes the front shielding, the wave trap and at least a part of the plurality of lamellae.

4. The wave choke device according to claim 1, wherein the lamellae extend in a radial direction within the plane of the oven door.

5. The wave choke device according to claim 1, wherein the one single piece comprises a grid made of metal wires.

6. The wave choke device according to claim 1, wherein the one single piece is made of metal in a raw condition.

7. The wave choke device according to claim 1, wherein the one single piece is made of metal with a treated surface.

8. The wave choke device according to claim 1, wherein the one single piece is made of a synthetic material treated with a conductive material.

9. The wave choke device according to claim 8, wherein the synthetic material is thermoplastics.

10. The wave choke device according to claim 1, wherein the wave trap forms a four-sided frame arranged on the outer portion of the front shielding.

11. An oven door for a microwave oven, wherein the oven door comprises a wave choke device according to claim 10.

12. A microwave oven, wherein the microwave oven comprises a wave choke device according to claim 10.

13. The oven door according to claim 11, wherein the oven door comprises at least one door panel.

14. The oven door according to claim 13, wherein the door panel is made of a dielectric and/or transparent material.

15. The oven door according to claim 14, wherein the door panel is made of glass, glass ceramics and/or plastics.

16. The oven door according to claim 15, wherein the wave choke device is arranged on the outer side of an inner door panel.

17. A microwave oven, wherein the microwave oven comprises an oven door according to claim 16.

* * * * *